US011108122B2

(12) United States Patent
Zhu et al.

(10) Patent No.: US 11,108,122 B2
(45) Date of Patent: Aug. 31, 2021

(54) TM MODE DIELECTRIC RESONATOR INCLUDING A RESONANT DIELECTRIC ROD SOLDERED TO A FIXING BASE WITHIN A HOUSING BASEPLATE, FOR FORMING A FILTER AND A COMMUNICATIONS DEVICE

(71) Applicant: HUAWEI TECHNOLOGIES CO., LTD., Guangdong (CN)

(72) Inventors: Yuntao Zhu, Shenzhen (CN); Zheng Li, Shenzhen (CN); Jinyan Li, Shenzhen (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 17 days.

(21) Appl. No.: 16/513,620

(22) Filed: Jul. 16, 2019

(65) Prior Publication Data

US 2019/0341663 A1 Nov. 7, 2019

Related U.S. Application Data

(63) Continuation of application No. PCT/CN2017/071605, filed on Jan. 18, 2017.

(51) Int. Cl.
*H01P 1/20* (2006.01)
*H01P 1/208* (2006.01)
(Continued)

(52) U.S. Cl.
CPC ..... *H01P 1/2084* (2013.01); *H01P 1/2002* (2013.01); *H01P 7/10* (2013.01); *H01P 11/008* (2013.01)

(58) Field of Classification Search
CPC ..... H01P 1/2084; H01P 7/10
(Continued)

(56) References Cited

U.S. PATENT DOCUMENTS 4,639,699 A 1/1987 Nishikawa et al.
6,535,086 B1 * 3/2003 Liang et al. ..... H01P 1/205 333/219.1
(Continued)

FOREIGN PATENT DOCUMENTS

CN 1581569 A 2/2005
CN 201749935 U 2/2011
(Continued)

*Primary Examiner* — Benny T Lee
(74) *Attorney, Agent, or Firm* — Womble Bond Dickinson (US) LLP

(57) ABSTRACT

A transverse magnetic mode dielectric resonator includes a housing with a top opening, a cover disposed on an opening side of the housing, a cavity body enclosed by the cover and the housing, an inner wall of the cavity body electrically conductive, a resonant dielectric rod disposed in the cavity body, a cavity disposed inside the resonant dielectric rod, a tuning part disposed on the cover, one end of the tuning part stretched into the cavity and capable of moving up and down relative to the cavity, two ends of the resonant dielectric rod respectively soldered with the cover and a baseplate of the housing, where a part that is of the cover and that is soldered with the resonant dielectric rod is made of elastic material, and a part that is of the baseplate and that is soldered with the resonant dielectric rod is made of elastic material.

19 Claims, 2 Drawing Sheets

(51) Int. Cl.
*H01P 7/10* (2006.01)
*H01P 11/00* (2006.01)

(58) Field of Classification Search
USPC ..... 333/202, 219.1, 235
See application file for complete search history.

(56) References Cited

U.S. PATENT DOCUMENTS

| | | | | |
|---|---|---|---|---|
| 8,854,160 | B2 * | 10/2014 | Park et al. ..... | H01P 7/10 333/219.1 |
| 2005/0030131 | A1 | 2/2005 | Yamakawa et al. | |
| 2013/0176088 | A1 | 7/2013 | Mao et al. | |

FOREIGN PATENT DOCUMENTS

| | | | |
|---|---|---|---|
| CN | 102136620 | A | 7/2011 |
| CN | 102222811 | A | 10/2011 |
| CN | 102324617 | A | 1/2012 |
| CN | 202363572 | U | 8/2012 |
| CN | 103972618 | A | 8/2014 |
| CN | 104170162 | A | 11/2014 |
| CN | 104821421 | A | 8/2015 |
| CN | 204706616 | U | 10/2015 |
| CN | 204706617 | U | 10/2015 |
| CN | 204706618 | U | 10/2015 |
| CN | 103151581 | B | 3/2016 |
| CN | 106129559 | A | 11/2016 |
| EP | 2323214 | A1 | 5/2011 |
| EP | 2538487 | A1 | 12/2012 |
| FR | 2534088 | A1 | 4/1984 |
| JP | S63250201 | A | 10/1988 |
| JP | 2005033327 | A | 2/2005 |
| JP | 2005073242 | A | 3/2005 |
| JP | 2012244412 | A | 12/2012 |
| KR | 101597109 | B1 | 2/2016 |

* cited by examiner

TM MODE DIELECTRIC RESONATOR INCLUDING A RESONANT DIELECTRIC ROD SOLDERED TO A FIXING BASE WITHIN A HOUSING BASEPLATE, FOR FORMING A FILTER AND A COMMUNICATIONS DEVICE

CROSS-REFERENCE TO RELATED APPLICATIONS

This application is a continuation of International Application No. PCT/CN2017/071605, filed on Jan. 18, 2017, the disclosure of which is hereby incorporated by reference in its entirety.

TECHNICAL FIELD

This application relates to the field of wireless communications technologies, and in particular, to a transverse magnetic mode dielectric resonator, a filter, and a communications device.

BACKGROUND

As a wireless communications system has increasingly higher requirements for high sensitivity in signal transmitting/receiving, a traverse magnetic (TM) mode dielectric resonator also becomes increasingly important in wireless communication. Compared with a conventional cavity resonator, the transverse magnetic mode dielectric resonator has advantages such as a small size, a low loss, low costs, high-temperature stability, and good harmonic suppression.

In the prior art, a transverse magnetic mode dielectric resonator is provided. As shown in FIG. 1, a cavity body 01 with a top opening is included, a cover 02 is fastened on an opening side of the cavity body 01 by using a screw, a resonant dielectric rod 03 is disposed in the cavity body 01, the resonant dielectric rod 03 has a cavity 031, and two ends of the resonant dielectric rod 03 are respectively fastened to the cover 02 and a bottom surface of the cavity body 01 through soldering. The resonant dielectric rod 03 is made of ceramic material, and the cavity body 01 and the cover 02 are usually made of metal material. In this way, when the two ends of the resonant dielectric rod 03 are respectively fastened to the cover 02 and the bottom surface of the cavity body 01 through soldering, because components have different coefficients of thermal expansion, and the tensile strength of the resonant dielectric rod 03 made of ceramic material is less than the tensile strength of the cavity body 01 and the cover 02, respectively that are made of metal material, the resonant dielectric rod 03 made of ceramic material is easily shattered and damaged under impact of thermodynamic deformation.

In the prior art, in order to absorb thermodynamic deformation of the transverse magnetic mode dielectric resonator in an operating environment to prevent the resonant dielectric rod 03 from being shattered and damaged, thin metal sheets 04 are disposed at both positions at which the two ends of the resonant dielectric rod 03 are respectively fastened to the cover 02 and the bottom surface of the cavity body 01 through soldering. Thermodynamic deformation of the cover 02, the cavity body 01, and the resonant dielectric rod 03 in the operating environment are absorbed by elastic deformation of the thin metal sheets 04, to prevent the resonant dielectric rod 03 from being shattered and damaged.

However, in the prior art, deformation gaps of the thin metal sheets 04 need to be reversed during assembly of the disposed thin metal sheets 04, so that the thin metal sheets 04 can be deformed to absorb the thermodynamic deformation of the cover 02, the cavity body 01, and the resonant dielectric rod 03 in the operating environment. In this case, very high assembly precision is required for the thin metal sheets 04, and therefore the thin metal sheets 04 are difficult to assemble. In addition, the thin metal sheets 04 are easily deformed during machining and assembly of the thin metal sheets 04, the deformed thin metal sheets 04 cause welds to be excessively large when the two ends of the dielectric resonator are soldered, and therefore reliability of the soldering is affected.

SUMMARY OF THE INVENTION

Embodiments of this application provide a transverse magnetic mode dielectric resonator, a filter, and a communications device, so that on a basis that thermodynamic deformation of the transverse magnetic mode dielectric resonator in an operating environment can be absorbed, assembly is relatively easy, and soldering reliability is relatively high.

To achieve the foregoing objectives, the following technical solutions are used in the embodiments of this application.

A first aspect of this application provides a transverse magnetic mode dielectric resonator, including a housing with a top opening, where a cover is disposed on an opening side of the housing, a cavity body is enclosed by the cover and the housing, an inner wall of the cavity body is electrically conductive, a resonant dielectric rod is disposed in the cavity body, a cavity is disposed inside the resonant dielectric rod, a tuning part is disposed on the cover, one end of the tuning part extends into the cavity and can move up and down relative to the cavity, two ends of the resonant dielectric rod are respectively soldered with the cover and a baseplate of the housing, a part that is of the cover and that is soldered with the resonant dielectric rod is made of elastic material, and a part that is of the baseplate and that is soldered with the resonant dielectric rod is made of elastic material.

In one embodiment, the part that is of the cover and that is soldered with the resonant dielectric rod is made of elastic material, and the part that is of the baseplate and that is soldered with the resonant dielectric rod is also made of elastic material. The two parts made of elastic material can well absorb thermodynamic deformation of the transverse magnetic mode dielectric resonator in an operating environment, thereby preventing the dielectric resonator from being shattered and damaged. In comparison with the prior art, elastic deformation of the cover is determined by a material feature of the cover, and no precise fitting slot between the cover and another component is needed, and therefore assembly is relatively easy.

In addition, the cover may be partially manufactured by using elastic material, or the cover may be fully manufactured by using elastic material. In comparison with the prior art in which a cover needs to be assembled with a thin metal sheet, deformation does not easily occur in machining and assembly processes. In addition, when the cover is fully manufactured by using elastic material, the cover is definitively definitely thicker than the thin metal sheet in terms of the prior art in thickness and size, and therefore deformation does not easily occur in the machining and assembly processes either. In conclusion, when the resonant dielectric rod is soldered with the cover, a normal weld distance can be ensured, and soldering reliability is improved. Likewise, because the part that is of the baseplate and that is soldered with the resonant dielectric rod is made of elastic material, the same effects can be achieved, to be specific, thermodynamic deformation of the transverse magnetic mode dielectric resonator in an operating environment can be absorbed, assembly is relatively easy, and soldering reliability is relatively high.

In one embodiment, the cover is made of insulating elastic material, a surface that is of the cover and that faces the inside of the cavity body is covered with a conductive layer, a conductive hole is opened on the cover, and the tuning part passes through the conductive hole and extends into the cavity of the resonant dielectric rod. The cover is fully made of insulating elastic material to absorb thermodynamic deformation in an operating environment. In addition, to transmit an electrical signal, the surface that is of the cover and that faces the inside of the cavity body is covered with the conductive layer, and the conductive hole is opened on the cover, so that the tuning part can pass through the conductive hole and stretch into the cavity of the resonant dielectric rod, to tune a resonance frequency of the transverse magnetic mode dielectric resonator. The conductive hole and the tuning part can ensure that the conductive layer is continuous in the conductive hole and can prevent leakage of an electromagnetic wave signal.

In one embodiment, the cover is a printed circuit board (PCB), the conductive layer covering the cover is a metal layer, and the conductive hole is a plated through hole that passes through the printed circuit board. The cover is the printed circuit board and the conductive layer is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced. The conductive layer is the metal layer, and therefore the conductive hole is configured as the plated through hole.

In one embodiment, a pad is disposed on an upper surface of the printed circuit board and encloses the plated through hole, a nut is soldered on the pad, the tuning part is a screw rod, the screw rod may be in threaded fitting with the nut, one end of the plated through hole is connected to the metal layer, and the other end is connected to the pad. To enable the tuning part to tune the resonance frequency of the transverse magnetic mode dielectric resonator, the tuning part needs to extend into the cavity of the resonant dielectric rod and be capable of moving up and down relative to the cavity, to disturb an electromagnetic field of the resonant dielectric rod, thereby implementing tuning. Therefore, the tuning part may be configured as the screw rod, and the nut that can fit the screw rod is soldered in the plated through hole, so that the screw rod can move up and down relative to the cavity through the fitting between the screw rod and the nut. In addition, to ensure that electrical conductivity is continuous in the plated through hole, the pad is disposed to enclose the plated through hole, and then the nut is soldered on the pad. In this way, with the plated through hole, the pad, and the nut, it is ensured that electrical conductivity is continuous in the plated through hole, and no electromagnetic wave within the cavity body enclosed by the cover and the housing can leak through the plated through hole.

In one embodiment, the baseplate of the housing includes a base connected to a side wall of the housing and a fixing base built into an upper surface of the base, the fixing base is soldered with the resonant dielectric rod, the fixing base is made of insulating elastic material, and a surface that is of the fixing base and that faces the inside of the cavity body is covered with a conductive layer. A part that is of the base and that is soldered with the resonant dielectric rod is the fixing base, the fixing base may be disposed inside the housing, and the fixing base is made of insulating elastic material. In addition, to enable the surface that is of the fixing base and that faces the inside of the cavity body to be electrically conductive, the surface that is of the fixing base and that faces the inside of the cavity body is covered with the conductive layer.

In one embodiment, the baseplate of the housing includes a base connected to a side wall of the housing and a fixing base built into a lower surface of the base, the resonant dielectric rod passes through the base and is soldered with an upper surface of the fixing base, the fixing base is made of insulating elastic material, and the upper surface of the fixing base is covered with a conductive layer. A part that is of the base and that is soldered with the resonant dielectric rod is the fixing base, and the fixing base may alternatively be disposed outside the housing. In this case, the resonant dielectric rod passes through the base and is soldered with the fixing base, and the fixing base is made of insulating elastic material. In addition, to enable the upper surface of the fixing base to be electrically conductive, the upper surface of the fixing base is covered with the conductive layer.

In one embodiment, the baseplate of the housing is made of insulating elastic material, and a surface that is of the baseplate and that faces the inside of the cavity body is covered with a conductive layer. The baseplate of the housing may be fully made of insulating elastic material, so that the resonant dielectric rod is conveniently fastened to the baseplate through soldering, and thermodynamic deformation of the transverse magnetic mode dielectric resonator in an operating environment can be absorbed. In addition, to ensure that the inside of the housing is electrically conductive, the surface that is of the baseplate and that faces the inside of the cavity body is covered with the conductive layer.

In one embodiment, the fixing base is a printed circuit board, and the conductive layer on the upper surface of the fixing base is a metal layer.

In one embodiment, the baseplate is a printed circuit board, and the conductive layer on the baseplate is a metal layer. The baseplate is the printed circuit board and the conductive layer is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced.

In one embodiment, the metal layer is less than or equal to 0.2 millimeters in thickness. For example, the metal layer is less than or equal to 0.2 millimeters in thickness, so that costs can be reduced while it is the metal layer with less than or equal to 0.2 millimeters in thickness can be ensured that the metal layer has good electrical conductivity, and can be ensured that the elastic material is almost not affected by the metal layer when elastic deformation occurs. In addition, the metal layer and the elastic material may be connected together by using a printed circuit board manufacturing technology, or may be connected together by using a technology such as electroplating, electroless plating, or chemical deposition on the elastic material.

In one embodiment, a locating slot is disposed on the base, and the fixing base may be disposed in the locating slot. Because the locating slot is disposed on the base for the fixing base and the fixing base may be disposed in the locating slot, this helps assemble the fixing base with the base.

According to a second aspect, an embodiment of this application provides a filter. The filter includes the transverse magnetic mode dielectric resonator according to the first aspect.

According to a third aspect, an embodiment of this application provides a communications device. The communications device includes the filter according to the second aspect.

In the second aspect and the third aspect, because the filter and the communications device that are provided in the embodiments of this application include the transverse magnetic mode dielectric resonator according to the first aspect, the filter and the communications device can also achieve technical effects of the embodiment of the first aspect. To be specific, thermodynamic deformation of the transverse magnetic mode dielectric resonator in an operating environment can be absorbed, assembly is relatively easy, and soldering reliability is relatively high.

BRIEF DESCRIPTION OF DRAWINGS

The following briefly describes accompanying drawings required for describing embodiments or the prior art.

DETAIL DESCRIPTION OF THE EMBODIMENTS

The following describes the technical solutions in the embodiments of this application with reference to the accompanying drawings in the embodiments of this application.

In descriptions of this application, directions or position relationships indicated by terms "center", "up", "down", "front", "rear", "left", "right", "vertical", "horizontal", "top", "bottom", "inside", "outside", and the like are directions or position relationships shown based on the accompanying drawings, and are merely intended to describe this application and simplify the descriptions, but are not intended to indicate or imply that an apparatus or a component shall have a specific direction or be formed and operated in a specific direction, and therefore shall not be understood as a limitation on this application.

In the descriptions of this application, it should be noted that unless otherwise specified or limited, terms such as "installation", "link", and "connection" shall be understood in a broad sense, for example, may be a fixed connection, or may be a detachable connection or an unitary connection; for persons of ordinary skill in the art, specific meanings of the foregoing terms in this application may be understood based on a specific case.

Figure 1:
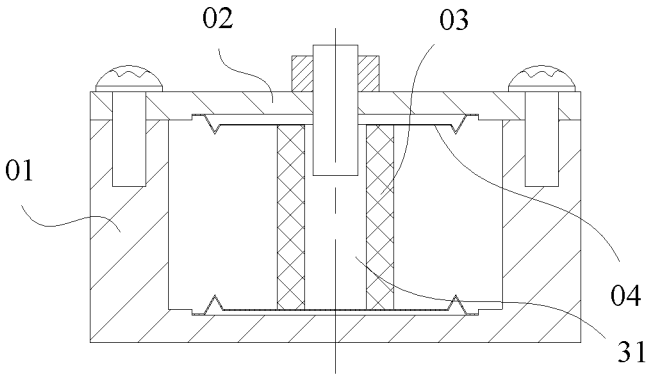
Prior Art FIG. 1
FIG. 1 is a schematic structural diagram of a transverse magnetic mode dielectric resonator in the prior art.
Figure 2:
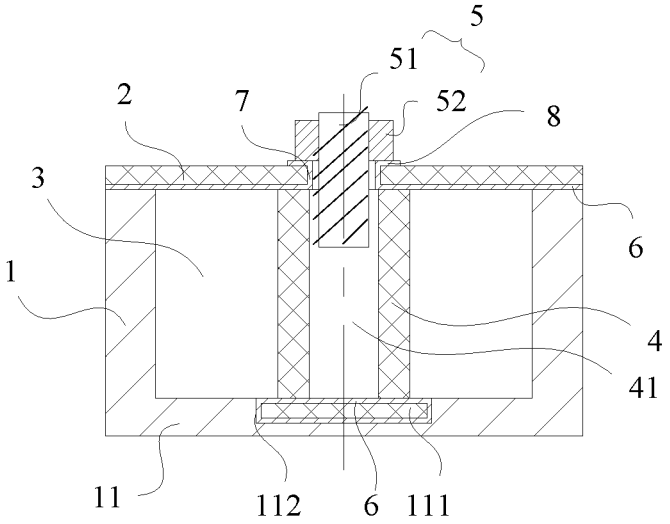
FIG. 2 is a schematic cross-sectional structural diagram of a transverse magnetic mode dielectric resonator according to an embodiment of this application.

An embodiment of this application provides a transverse magnetic mode dielectric resonator. Referring to FIG. 2, a housing 1 with a top opening is included, a cover 2 is disposed on the top opening side of the housing 1, a cavity body 3 is enclosed by the cover 2 and the housing 1, an inner wall of the cavity body 3 is electrically conductive, a resonant dielectric rod 4 is disposed in the cavity body 3, a cavity 41 is disposed inside the resonant dielectric rod 4, a tuning part 5 is disposed on the cover 2, one end of the tuning part 5 extends into the cavity 41 and can move up and down through the cavity 41, two ends of the resonant dielectric rod 4 are respectively soldered with the cover 2 and a baseplate 11 of the housing 1, a part that is of the cover 2 and that is soldered with the resonant dielectric rod 4 is made of elastic material, and a part that is of the baseplate 11 and that is soldered with the resonant dielectric rod 4 is made of elastic material.

In one embodiment, the part that is of the cover 2 and that is soldered with the resonant dielectric rod 4 is made of elastic material, and the part that is of the baseplate 11 and that is soldered with the resonant dielectric rod 4 is also made of elastic material. The two parts made of elastic material can well absorb thermodynamic deformation of the transverse magnetic mode dielectric resonator in an operating environment, thereby preventing the dielectric resonator from being shattered and damaged. In comparison with the prior art, elastic deformation of the cover 2 is determined by a material feature of the cover 2, and no precise fitting slot between the cover 2 and another component is needed, and therefore assembly is relatively easy.

In addition, the cover 2 may be partially manufactured by using elastic material, or the cover 2 may be fully manufactured by using elastic material. In comparison with the prior art in which a cover needs to be assembled with a thin metal sheet, deformation does not easily occur in machining and assembly processes. In addition, when the cover 2 is fully manufactured by using elastic material, the cover 2 is definitively thicker than the thin metal sheet in the prior art in thickness and size, and therefore deformation does not easily occur in the machining and assembly processes either. In conclusion, when the resonant dielectric rod 4 is soldered with the cover 2, a normal weld distance can be ensured, and soldering reliability is improved. Likewise, because the part that is of the baseplate 11 and that is soldered with the resonant dielectric rod 4 is made of elastic material, effects achieved when the part that is of the cover 2 and that is soldered with the resonant dielectric rod 4 is made of elastic material can also be achieved, to be specific, thermodynamic deformation of the transverse magnetic mode dielectric resonator in an operating environment can be absorbed, assembly is relatively easy, and soldering reliability is relatively high.

In one embodiment, the part that is of the cover 2 and that is soldered with the resonant dielectric rod 4 may be made of elastic material, or the cover 2 may be fully made of elastic material; likewise, the part that is of the baseplate 11 and that is soldered with the resonant dielectric rod 4 may be made of elastic material, or the baseplate 11 may be fully made of elastic material. According to a transverse magnetic mode dielectric resonator in an embodiment of this application, soldering between parts may be performed by selecting a soldering technology. Soldering is a method in which metal material whose melting point is lower than that of base metal is used as solder, a weldment and the solder are heated to a temperature higher than a melting point of the solder and lower than a melting temperature of the base metal, and liquid solder is used to wet the base metal, pad a joint gap, and diffuse with the base metal to connect the weldment. The method is applicable to soldering precise and complex components that are made of different materials.

In one embodiment, as shown in FIG. 2, the cover 2 is made of insulating elastic material, a surface that is of the cover 2 and that faces the inside of the cavity body 3 is covered with a conductive layer 6, a conductive hole 7 is opened on the cover 2, and the tuning part 5 passes through the conductive hole 7 and extends into the cavity 41 of the resonant dielectric rod 4. The cover 2 is fully made of insulating elastic material to absorb thermodynamic deformation in an operating environment. In addition, to transmit an electrical signal, the surface that is of the cover 2 and that faces the inside of the cavity body 3 is covered with the conductive layer 6, and the conductive hole 7 is that passes through the cover 2, so that the tuning part 5 can pass through the conductive hole 7 and extend into the cavity 41 of the resonant dielectric rod 4, to tune a resonance frequency of the transverse magnetic mode dielectric resonator. The conductive hole 7 and the tuning part 5 can ensure that the conductive layer 6 is continuous in the conductive hole 7 and can prevent leakage of an electromagnetic wave signal.

In one embodiment, the cover 2 is a printed circuit board, the conductive layer 6 covering the cover 2 is a metal layer covering a lower surface of the printed circuit board, and the conductive hole 7 is a plated through hole that passes through the printed circuit board. The cover 2 is the printed circuit board and the conductive layer 6 is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced. The conductive layer 6 is the metal layer, and therefore the conductive hole 7 is configured as the plated through hole.

To enable the tuning part 5 to tune the resonance frequency of the transverse magnetic mode dielectric resonator, in one embodiment, the tuning part 5 needs to extend into the cavity 41 of the resonant dielectric rod 4 and be capable of moving up and down through the cavity 41, to change an electromagnetic field of the resonant dielectric rod 4, thereby implementing tuning. That the tuning part 5 moves up and down through the cavity 41 may have a plurality of implementations, for example, a structure in which a nut fits a screw rod or a pin fits a hole. The structure in which a nut fits a screw rod is easy to implement, simple, and reliable. The structure in which a nut fits a screw rod is used as an example below to describe a specific implementation. As shown in FIG. 2, a pad 8 covers an upper surface of the printed circuit board and encloses the plated through hole, a nut 52 is soldered on the pad 8, the tuning part 5 is a screw rod 51, the screw rod 51 may be in threaded fitting with the nut 52, one end of the plated through hole is connected to the metal layer, and the other end is connected to the pad 8. Optionally, the tuning part 5 may be configured as the screw rod 51, and the nut 52 that can fit the screw rod 51 is soldered in the plated through hole, so that the screw rod 51 can move up and down relative to the cavity 41 through the fitting between the screw rod 51 and the nut 52.

In addition, to ensure that electrical conductivity is continuous in the plated through hole, the pad 8 covers and encloses the plated through hole, and then the nut 52 is soldered on the pad 8. In this way, with the plated through hole, the pad 8, and the nut 52, it is ensured that electrical conductivity is continuous in the plated through hole, and no electromagnetic wave within the cavity body 3 enclosed by the cover 2 and the housing 1 can leak through the plated through hole.

In one embodiment, the metal layer is less than or equal to 0.2 millimeters in thickness. Material that is relatively soft in texture may be selected as specific metal material. In this way, when insulating elastic material absorbs thermodynamic deformation, the metal layer and the insulating elastic material are deformed together, so that the metal layer is not broken off or damaged. Metal such as copper, silver, or tin may be selected as material of the metal layer, but the material of the metal layer is not limited to the three examples. In addition, the metal layer and the elastic material may be connected together by using a printed circuit board manufacturing technology, or may be connected together by using a technology such as electroplating, electroless plating, or chemical deposition on the elastic material.

In one embodiment, as shown in FIG. 2, the baseplate 11 of the housing 1 includes a base connected to a side wall of the housing 1 and a fixing base 111 built into an upper surface of the base, the fixing base 111 is soldered with the resonant dielectric rod 4, the fixing base 111 is made of insulating elastic material, and a surface that is of the fixing base 111 and that faces the inside of the cavity body 3 is covered with a conductive layer 6. Optionally, the fixing base 111 is a printed circuit board, and the conductive layer 6 on the upper surface of the fixing base 111 is a metal layer covering an upper surface of the printed circuit board. The fixing base 111 is the printed circuit board and the conductive layer 6 is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced.

In one embodiment, the fixing base 111 is connected to the base through soldering. A surface of a part that is of the fixing base 111 and that is in contact with the housing 1 may also be covered with the conductive layer 6, to help connect the fixing base 111 to the base through soldering. Optionally, to help assemble the base with the fixing base 111, as shown in FIG. 2, a locating slot 112 is disposed on the base, and the fixing base 111 may be disposed in the locating slot 112, to help assemble the base with the fixing base 111.

Figure 3:
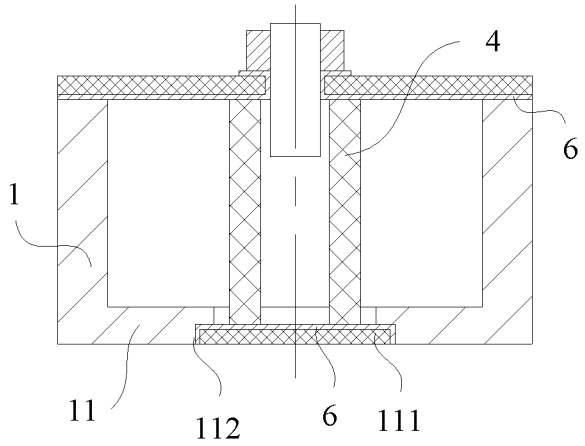
FIG. 3 is a schematic cross-sectional structural diagram of a transverse magnetic mode dielectric resonator in which a fixing base is built into a lower surface of a base according to an embodiment of this application.

In one embodiment, as shown in FIG. 3, a housing 1 with a top opening is included, a cover is disposed on an opening side of the housing 1, a tuning part is disposed on the cover, one end of the tuning part extends stretches into the cavity and can move up and down through the cavity, the baseplate 11 of the housing 1 includes a base connected to a side wall of the housing 1 and a fixing base 111 built into a lower surface of the base, the resonant dielectric rod 4 passes through the base and is soldered with an upper surface of the fixing base 111, the fixing base 111 is made of insulating elastic material, and the upper surface of the fixing base 111 is covered with a conductive layer 6. Optionally, the fixing base 111 is a printed circuit board, and the conductive layer 6 on the upper surface of the fixing base 111 is a metal layer covering an upper surface of the printed circuit board. The fixing base 111 is the printed circuit board and the conductive layer 6 is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced.

In one embodiment, the fixing base 111 is connected to the base through soldering. A surface of a part that is of the fixing base 111 and that is in contact with the housing 1 may also be covered with the conductive layer 6, to help connect the fixing base 111 to the base through soldering. To help assemble the base with the fixing base 111, as shown in FIG. 3, a locating slot 112 is disposed on the base, and the fixing base 111 may be disposed in the locating slot 112.

Figure 4:
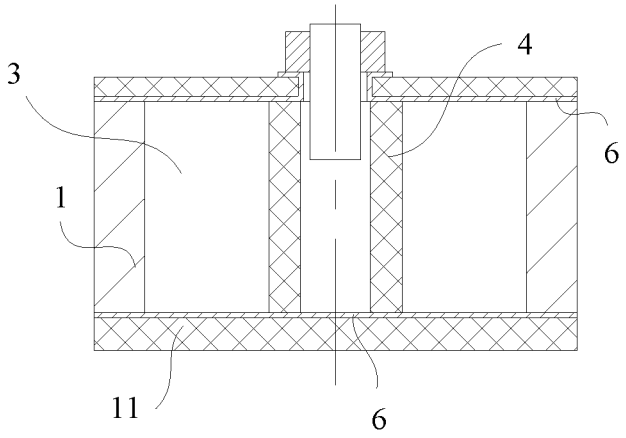
FIG. 4 is a schematic cross-sectional structural diagram of a transverse magnetic mode dielectric resonator in which a baseplate is made of insulating elastic material according to an embodiment of this application.

In one embodiment, as shown in FIG. 4, a housing 1 with a top opening is included, a cover is disposed on an opening side of the housing 1, a tuning part is disposed on the cover, one end of the tuning part extends into the cavity and can move up and down through the cavity, the baseplate 11 of the housing 1 is made of insulating elastic material, and a surface that is of the baseplate 11 and that faces the inside of the cavity body 3 is covered with a conductive layer 6. The baseplate 11 of the housing 1 is fully made of insulating elastic material. This reduces machining time while the resonant dielectric rod 4 is conveniently fastened to the baseplate 11 through soldering and thermodynamic deformation of the transverse magnetic mode dielectric resonator in an operating environment can be absorbed. In addition, to ensure that the inside of the housing 1 is electrically conductive, the surface that is of the baseplate 11 and that faces the inside of the cavity body 3 is covered with the conductive layer 6.

In one embodiment, the baseplate 11 is a printed circuit board, and the conductive layer 6 on the baseplate 11 is a metal layer covering an upper surface of the printed circuit board. The baseplate 11 is the printed circuit board and the conductive layer 6 is the metal layer, because the printed circuit board is made of plastic material, has relatively good elasticity, and can absorb some thermodynamic deformation; a manufacturing technology of covering a metal layer on a printed circuit board is a stable manufacturing process and has high machining precision, and this further improves soldering reliability; in addition, in comparison with a thin metal sheet, material costs of the printed circuit board are greatly reduced.

In one embodiment, the metal layer may be less than or equal to 0.2 millimeters in thickness. Material that is relatively soft in texture may be selected as specific metal material. In this way, when insulating elastic material absorbs thermodynamic deformation, the metal layer and the insulating elastic material are deformed together, so that the metal layer is not broken off or damaged. Metal such as copper, silver, or tin may be selected as material of the metal layer, but the material of the metal layer is not limited to the three examples. In addition, the metal layer and the elastic material may be connected together by using a printed circuit board manufacturing technology, or may be connected together by using a technology such as electroplating, electroless plating, or chemical deposition on the elastic material.

An embodiment of this application provides a filter. The filter includes the transverse magnetic mode dielectric resonator in the foregoing embodiments.

In one embodiment, the filter may include at least one of the foregoing transverse magnetic mode dielectric resonators. Optionally, the filter may alternatively include another type of resonator that is cascaded with the foregoing transverse magnetic mode dielectric resonator. Optionally, the filter may further include another element. For example, the filter may further include a capacitor, a resistor, an inductor, or the like.

An embodiment of this application provides a communications device. The communications device includes the filter according to the foregoing embodiment. The communications device may be a duplexer, a wireless transceiver device, a base station, or the like.

In one embodiment, because the transverse magnetic mode dielectric resonator according to the first aspect is included, on a basis that thermodynamic deformation of the transverse magnetic mode dielectric resonator in an operating environment can be absorbed, assembly is relatively easy, and soldering reliability is relatively high.

Finally, it should be noted that the foregoing embodiments are merely intended for describing the technical solutions of this application, but not for limiting this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of this application.

What is claimed is:

1. A transverse magnetic (TM) mode dielectric resonator, comprising:

a housing with an opening at a top of the housing, wherein a cover is disposed on the top of the housing;

a cavity body enclosed by the cover and the housing, wherein an inner wall of the cavity body is electrically conductive;

a resonant dielectric rod disposed inside the cavity body, wherein a cavity is disposed inside the resonant dielectric rod;

a tuning part disposed on the cover, wherein one end of the tuning part extends into the cavity and can move up and down through the cavity of the resonant dielectric rod, wherein the resonant dielectric rod is soldered with the cover, wherein the tuning part comprises a screw rod in threaded fitting with a nut, and wherein a part of the cover soldered with the resonant dielectric rod is made of elastic material; and a fixing base built into a lower surface of a baseplate of the housing, wherein the resonant dielectric rod passes through the baseplate and is soldered with an upper surface of the fixing base, wherein the fixing base is made of insulating elastic material and the upper surface of the fixing base is covered with a conductive layer.

2. The dielectric resonator according to claim 1, wherein the cover is made of insulating elastic material, wherein a surface of the cover facing the inside of the cavity body is covered with a conductive layer, wherein a conductive hole is extended through the cover, and wherein the tuning part passes through the conductive hole and extends into the cavity of the resonant dielectric rod.

3. The dielectric resonator according to claim 2, wherein the cover is a printed circuit board (PCB), the conductive layer covering the surface of the cover is a metal layer, and the conductive hole is a plated through hole extended through the printed circuit board.

4. The dielectric resonator according to claim 3, wherein a pad is disposed on an upper surface of the printed circuit board, wherein a nut is soldered on the pad, and wherein one end of the plated through hole is connected to the metal layer and the other end is connected to the pad.

5. The dielectric resonator according to claim 3, wherein the metal layer is less than or equal to 0.2 millimeters in thickness.

6. The dielectric resonator according to claim 1, wherein the baseplate is connected to a side wall of the housing.

7. The dielectric resonator according to claim 6, wherein the conductive layer covering the upper surface of the fixing base is a metal layer.

8. The dielectric resonator according to claim 6, wherein a locating slot is disposed on the baseplate, and the fixing base is disposed in the locating slot.

9. The dielectric resonator according to claim 1, wherein the baseplate of the housing is made of insulating elastic material, and wherein a surface of the baseplate facing the inside of the cavity body is covered with a conductive layer.

10. The dielectric resonator according to claim 9, wherein the baseplate is a printed circuit board, and the conductive layer on the baseplate is a metal layer.

11. The dielectric resonator according to claim 1, wherein the conductive layer covering the surface of the fixing base is a metal layer.

12. The dielectric resonator according to claim 1, wherein a locating slot is disposed on the baseplate, and the fixing base is disposed in the locating slot.

13. A filter, comprising:

a transverse magnetic (TM) mode dielectric resonator, the TM mode dielectric resonator comprising a housing with an opening at a top of the housing, wherein a cover is disposed on the top of the housing;

a cavity body enclosed by the cover and the housing, wherein an inner wall of the cavity body is electrically conductive;

a resonant dielectric rod disposed inside the cavity body, wherein a cavity is disposed inside the resonant dielectric rod;

a tuning part disposed on the cover, wherein one end of the tuning part extends into the cavity and can move up and down through the cavity of the resonant dielectric rod, wherein the resonant dielectric rod is soldered with the cover, wherein the tuning part comprises a screw rod in threaded fitting with a nut, and wherein a part of the cover soldered with the resonant dielectric rod is made of elastic material; and a fixing base built into a lower surface of a baseplate of the housing, wherein the resonant dielectric rod passes through the baseplate and is soldered with an upper surface of the fixing base, wherein the fixing base is made of insulating elastic material and the upper surface of the fixing base is covered with a conductive layer.

14. The filter according to claim 13, wherein the cover is made of insulating elastic material, wherein a surface of the cover facing the inside of the cavity body is covered with a conductive layer, wherein a conductive hole is extended through the cover, and wherein the tuning part passes through the conductive hole and extends into the cavity of the resonant dielectric rod.

15. The filter according to claim 14, wherein the cover is a printed circuit board (PCB), the conductive layer covering the surface of the cover is a metal layer, and the conductive hole is a plated through hole opened on the printed circuit board.

16. The filter according to claim 15, wherein a pad is disposed on an upper surface of the printed circuit board, wherein a nut is soldered on the pad, and wherein one end of the plated through hole is connected to the metal layer and the other end is connected to the pad.

17. A communications device, comprising:

a filter having a transverse magnetic (TM) mode dielectric resonator, the TM mode dielectric resonator comprising a housing with an opening at a top of the housing, wherein a cover is disposed on the top of the housing;

a cavity body enclosed by the cover and the housing, wherein an inner wall of the cavity body is electrically conductive;

a resonant dielectric rod disposed inside the cavity body, wherein a cavity is disposed inside the resonant dielectric rod;

a tuning part disposed on the cover, wherein one end of the tuning part extends into the cavity and can move up and down through the cavity of the resonant dielectric rod, wherein the resonant dielectric rod is soldered with the cover, wherein the tuning part comprises a screw rod in threaded fitting with a nut, and wherein a part of the cover soldered with the resonant dielectric rod is made of elastic material; and a fixing base built into a lower surface of a baseplate of the housing, wherein the resonant dielectric rod passes through the baseplate and is soldered with an upper surface of the fixing base, wherein the fixing base is made of insulating elastic material and the upper surface of the fixing base is covered with a conductive layer.

18. The communications device according to claim 17, wherein the cover is made of insulating elastic material, wherein a surface of the cover facing the inside of the cavity body is covered with a conductive layer, wherein a conductive hole is extended through the cover, and wherein the tuning part passes through the conductive hole and extends into the cavity of the resonant dielectric rod.

19. The communications device according to claim 18, wherein the cover is a printed circuit board (PCB), the conductive layer covering the surface of the cover is a metal layer, and the conductive hole is a plated through hole opened on the printed circuit board.

* * * * *